US010427427B2

(12) United States Patent
Suzuki

(10) Patent No.: US 10,427,427 B2
(45) Date of Patent: Oct. 1, 2019

(54) PRINTING APPARATUS THAT DETECTS WHETHER A PRINT MEDIUM RUNS OUT AND, DURING DOUBLE-SIDED PRINTING, DISCARDS IMAGE DATA TO BE PRINTED ON THE RUN OUT PRINT MEDIUM, AND RELATED PRINT CONTROL METHOD

(71) Applicant: CANON KABUSHIKI KAISHA, Tokyo (JP)

(72) Inventor: Hiroshi Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/030,219

(22) Filed: Jul. 9, 2018

(65) Prior Publication Data

US 2019/0016159 A1 Jan. 17, 2019

(30) Foreign Application Priority Data

Jul. 13, 2017 (JP) ..... 2017-137341

(51) Int. Cl.
*B41J 3/60* (2006.01)
*B41J 11/00* (2006.01)
*B41J 13/00* (2006.01)

(52) U.S. Cl.
CPC ..... *B41J 11/0095* (2013.01); *B41J 3/60* (2013.01); *B41J 13/0045* (2013.01)

(58) Field of Classification Search
CPC ..... B41J 11/0095; B41J 3/60; B41J 13/0045; G03G 15/234; G03G 2215/00603; G03G 2215/00556; G03G 2215/00025
USPC ..... 347/5, 16, 101, 104
See application file for complete search history.

(56) References Cited

U.S. PATENT DOCUMENTS 6,970,263 B2 11/2005 Suzuki et al.
7,173,728 B2 2/2007 Suzuki et al.
7,729,005 B2 6/2010 Okanishi et al.
8,770,698 B2 * 7/2014 Ochiai ..... B41J 3/60 347/104
2014/0118763 A1 * 5/2014 Minakuchi ..... H04N 1/00763 358/1.12

FOREIGN PATENT DOCUMENTS

JP 2006-195426 A 7/2006
JP 2015-189079 A 2/2015

* cited by examiner

*Primary Examiner* — An H Do
(74) *Attorney, Agent, or Firm* — Venable LLP

(57) ABSTRACT

A printing apparatus includes a hold unit holds a print medium, with an image being printed on a first surface, to print on a second surface, as a back surface of the first surface, in double-sided printing. If a detection unit detects that a print medium fed from a feeding unit runs out, while the hold unit holds the print medium, with the image being printed on the first surface by a print unit, during execution of double-sided printing, a control unit controls data reading so as to read and to discard image data, corresponding to an image to be printed on the runout print medium, from a storage unit, to cause a conveyance unit to convey the held print medium from the hold unit to the print unit, and to cause the print unit to print an image on the second surface of the held print medium.

20 Claims, 13 Drawing Sheets

PRINTING APPARATUS THAT DETECTS WHETHER A PRINT MEDIUM RUNS OUT AND, DURING DOUBLE-SIDED PRINTING, DISCARDS IMAGE DATA TO BE PRINTED ON THE RUN OUT PRINT MEDIUM, AND RELATED PRINT CONTROL METHOD

This application claims the benefit of Japanese Patent Application No. 2017-137341, filed Jul. 13, 2017, which is hereby incorporated by reference herein in its entirety.

BACKGROUND OF THE INVENTION

Field of the Invention

The present invention relates to a printing apparatus and a related print control method, and, more particularly, for example, to a printing apparatus that transfers, to a print medium, an image formed by discharging ink to a transfer member from a printhead and prints the image, and a related print control method.

Description of the Related Art

Conventionally, there is known a printing apparatus that performs printing by forming an image by discharging ink to a print medium with a full-line printhead having a print width corresponding to the width of the print medium. In such an apparatus, an ink discharge timing is controlled based on a timing at which a sensor detects the leading edge position of a print medium fed from a cassette (for example, Japanese Patent Laid-Open No. 2015-189079).

There is also known a printing apparatus capable of performing printing on the two sides of a sheet-like print medium, such as a printing paper sheet. In such an apparatus, if a paper sheet runs out during execution of double-sided printing, control is performed so as to discharge a paper sheet having undergone printing on its front surface and standing by in the apparatus after printing on its back surface is also completed, preventing wasteful use of the paper sheet (for example, Japanese Patent Laid-Open No. 2006-195426).

In the related art, however, it is impossible to apply, for example, the control described in Japanese Patent Laid-Open No. 2006-195426 to a printing apparatus configured to control double-sided printing triggered by detection of the edge position of a print medium fed from a paper sheet cassette.

To cope with such control, software is generally used to perform the control. In a printing apparatus that performs high-speed printing, however, a print data amount per unit time also increases. Therefore, in order to achieve a processing speed to cope with the problem described above, control by hardware is also required.

SUMMARY OF THE INVENTION

Accordingly, the present invention is conceived as a response to the above-described disadvantages of the conventional art.

For example, a printing apparatus and a related print control method according to this invention are capable of performing high-speed print control even in a case in which double-sided printing is performed when triggered by detection of the edge position of a fed print medium.

According to one aspect, the present invention provides a printing apparatus comprising a storage unit configured to externally receive and store image data used to print the images, a detection unit configured to detect presence and absence of a print medium fed from a feeding unit, a print unit configured to read out, in accordance with detection of the print medium fed from the feeding unit by the detection unit, image data for printing an image on the print medium detected by the detection unit from the storage unit and to print the image on the print medium based on the image data, a hold unit configured to hold a print medium with an image being printed on a first surface to print on a second surface, as a back surface of the first surface, in double-sided printing, and a control unit configured to control, if the detection unit detects that a print medium fed from the feeding unit runs out while the hold unit holds the print medium with the image being printed on the first surface by the print unit during execution of a sequence of the double-sided printing, data reading so as to read and to discard image data corresponding to an image to be printed on the runout print medium from the storage unit, to cause a conveyance unit to convey the held print medium from the hold unit to the print unit, and to cause the print unit to print an image on the second surface of the held print medium.

According to another aspect, the present invention provides a print control method of a printing apparatus, the method comprising externally receiving and storing image data used to print the images in a memory, detecting, by a sensor, presence and absence of a print medium fed from a feeding unit, in accordance with detection of the print medium fed from the feeding unit by the sensor, reading out image data for printing an image on the detected print medium from the memory and printing the image on the print medium based on the image data, holding, by a double-sided unit, a print medium with an image being printed on a first surface to print on a second surface, as a back surface of the first surface, in double-sided printing, and, if the sensor detects that a print medium fed from the feeding unit runs out while the double-sided unit holds the print medium with the image being printed on the first surface by the printing during execution of a sequence of the double-sided printing, controlling data reading so as to read and to discard image data corresponding to an image to be printed on the runout print medium from the memory, to cause a conveyance unit to convey the print medium held by the double-sided unit from the double-sided unit, and to cause a print unit to print an image on the second surface of the held print medium.

The invention is particularly advantageous since it is possible to perform high-speed print control even in a case in which double-sided printing is performed when triggered by detection of the edge position of a fed print medium.

Further features of the present invention will become apparent from the following description of exemplary embodiments (with reference to the attached) drawings.

DESCRIPTION OF THE EMBODIMENTS

Embodiments of the present invention will now be described in detail in accordance with the accompanying drawings. Note that, in each drawing, arrows X and Y indicate horizontal directions perpendicular to each other, and an arrow Z indicates a up/down direction.

Description of Terms

In this specification, the terms "print" and "printing" not only include the formation of significant information, such as characters and graphics, but also broadly includes the formation of images, figures, patterns, and the like, on a print medium, or the processing of the medium, regardless of whether they are significant or insignificant and regardless of whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, that are capable of accepting ink.

Furthermore, the term "ink" (to be also referred to as a "liquid" hereafter) should be broadly interpreted to be similar to the definition of "print" described above. That is, "ink" includes a liquid that, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component. It is assumed, however, that this embodiment uses water-base ink including water, resin, and pigment serving as coloring material.

Further, a "print element (or nozzle)" generally means an ink orifice or a liquid channel communicating with the ink orifice, and an element for generating energy used to discharge ink, unless otherwise specified.

An element substrate for a printhead (head substrate) used below means not merely a base made of a silicon semiconductor, but an arrangement in which elements, wirings, and the like, are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process, or the like.

Printing System

Figure 1:
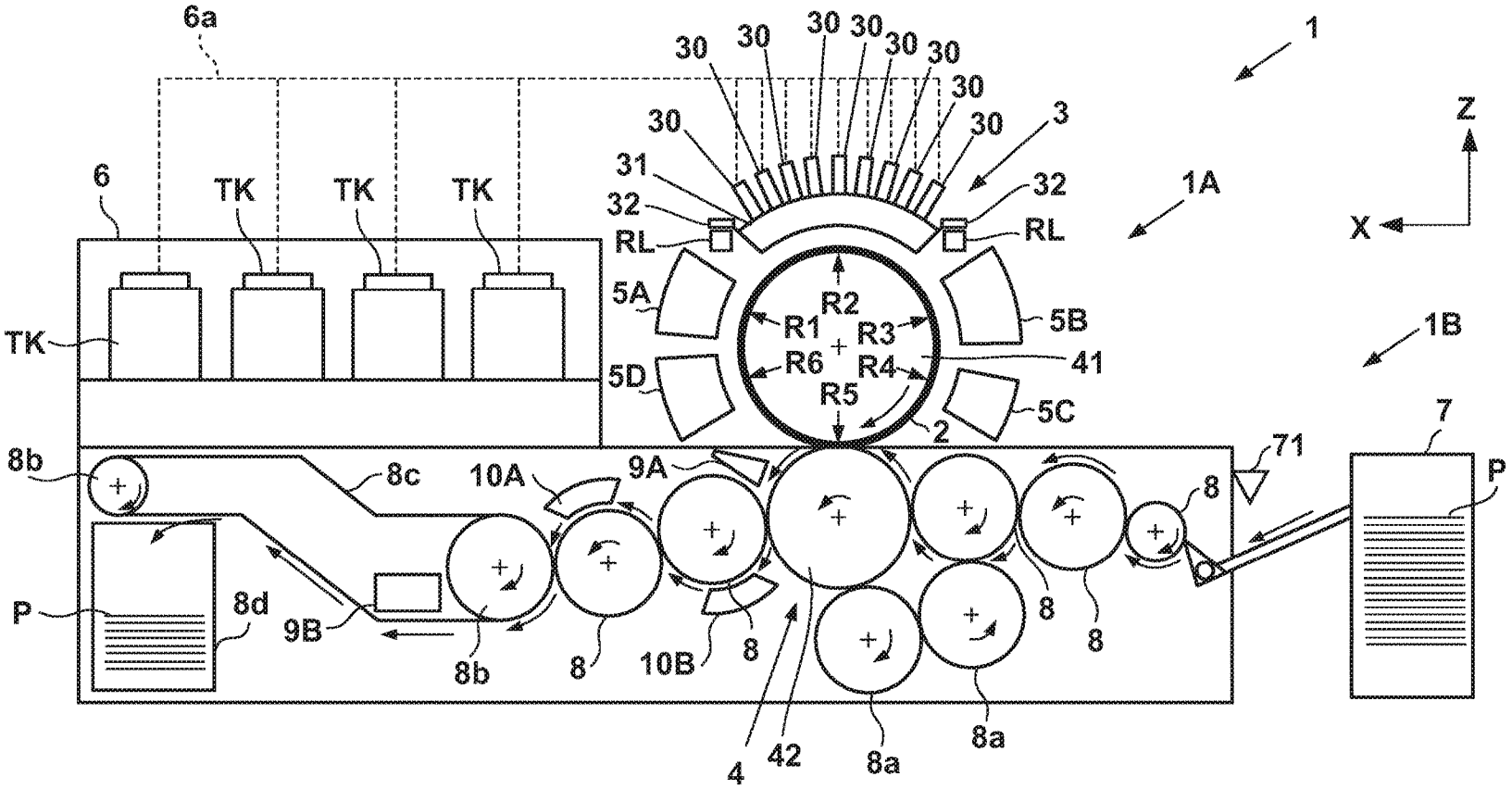
FIG. 1 is a schematic view showing a printing system according to an embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Printing Apparatus

The printing apparatus 1A includes a print unit 3, a transfer unit 4, peripheral units 5A to 5D, and a supply unit 6.

Print Unit

Figure 2:
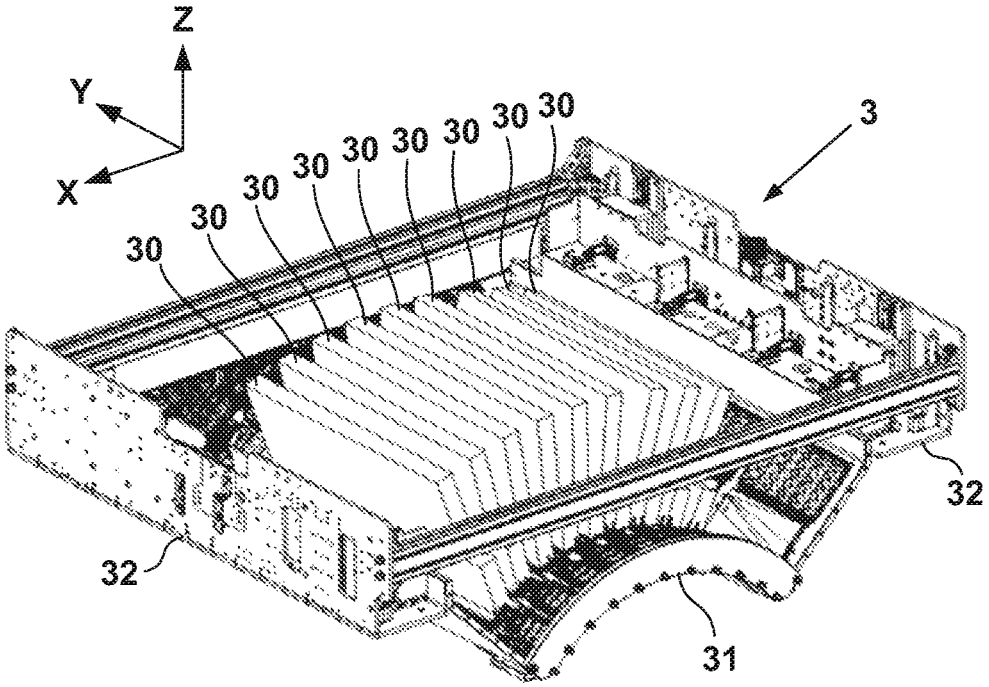
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range in which they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move in a circular orbit cyclically, and thus, the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like, can be used as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. One printhead 30 may, however, be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
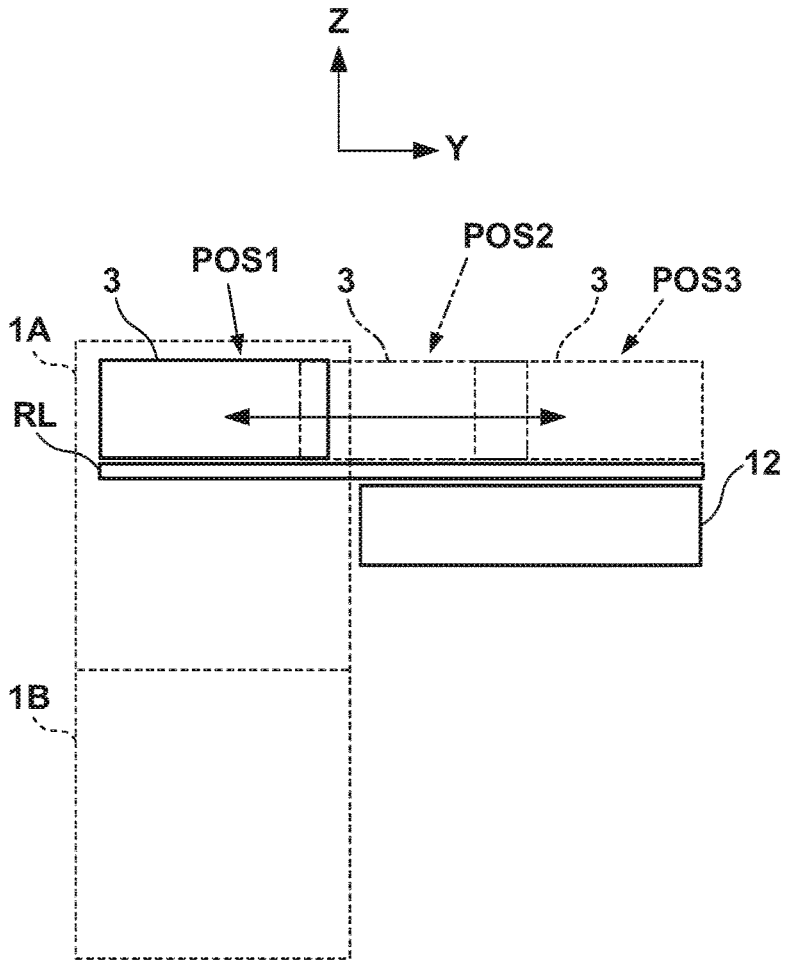
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism that caps the ink discharge surface of each printhead 30, a wiper mechanism that wipes the ink discharge surface, and a suction mechanism that sucks ink in the printhead 30 by a negative pressure from the ink discharge surface can be used as the mechanism.

The guide member RL is elongated over the recovery unit 12 from the side of the transfer member 2. By the guide of the guide member RL, the print unit 3 is displaceable between a discharge position POS1, at which the print unit 3 is indicated by a solid line, and a recovery position POS3, at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

Transfer Unit

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counter-clockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically in the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area in which preprocessing is performed on the transfer member 2 before the print unit 3 discharges ink and an area in which the peripheral unit 5A performs processing. In this embodiment, a reactive liquid is applied. The discharge area R2 is a formation area in which the print unit 3 forms an ink image by discharging ink to the transfer member 2. The processing areas R3 and R4 after discharge are processing areas in which processing is performed on the ink image after ink discharge. The processing area R3 after discharge is an area in which the peripheral unit 5B performs processing, and the processing area R4 after discharge is an area in which the peripheral unit 5C performs processing. The transfer area R5 is an area in which the transfer unit 4 transfers the ink image on the transfer member 2 to the print medium P. The processing area R6 after transfer is an area in which post processing is performed on the transfer member 2 after transfer and an area in which the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface on which the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic, can be used appropriately. With respect to of durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of these treatments may be combined. It is also possible to provide any desired surface shape in the surface layer.

For example, acrylonitrile-butadiene rubber, acrylic rubber, chloroprene rubber, urethane rubber, silicone rubber, or the like, can be used as a material for the compressed layer. When such a rubber material is formed, a porous rubber material may be formed by blending a predetermined amount of a vulcanizing agent, vulcanizing accelerator, or the like, and further blending a foaming agent, or a filling agent, such as hollow fine particles or salt, as needed. Consequently, a bubble portion is compressed along with a volume change with respect to various pressure fluctuations, and thus, deformation in directions other than a compression direction is small, making it possible to obtain more stable transferability and durability. As the porous rubber material, there are a material having an open cell structure, in which respective pores continue to each other, and a material having a closed cell structure, in which the respective pores are independent of each other. Either structure may, however be used, or both of these structures may be used.

As a member for the elastic layer, the various materials, such as the resin and the ceramic can be used appropriately. With respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or to maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source, such as a motor that drives them. A driving force can be delivered by a transmission mechanism, such as a gear mechanism.

Peripheral Unit

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism that applies the reactive liquid onto the transfer member 2 before the print unit 3 discharges ink. The reactive liquid is a liquid that contains a component increasing an ink viscosity. An increase in ink viscosity here means that a coloring material, a resin, and the like, that form the ink react chemically or suck physically by contacting the component that increases the ink viscosity, recognizing the increase in ink viscosity. This increase in ink viscosity includes not only a case in which an increase in viscosity of entire ink is recognized, but also a case in which a local increase in viscosity is generated by coagulating some of components, such as the coloring material and the resin that form the ink.

The component that increases the ink viscosity can use, without particular limitation, a substance, such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like, can be used as a mechanism that applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content, such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or less than 10 μm in order to suppress adherence of an ink solid content to the liquid absorbing member. The pore size here refers to an average diameter and can be measured by a known means, such as a mercury intrusion technique, a nitrogen adsorption method, a scanning electron microscope (SEM) image observation, or the like. Note that the liquid component does not have a fixed shape, and is not particularly limited if it has fluidity and an almost constant volume. For example, water, an organic solvent, or the like, contained in the ink or reactive liquid can be used as the liquid component.

The heating unit 5C is a mechanism that heats the ink image on the transfer member 2 before transfer. A resin in the ink image melts by heating the ink image, improving transferability to the print medium P. A heating temperature can be equal to or greater than the minimum film forming temperature (MFT) of the resin. The MFT can be measured by each apparatus that complies with a generally known method, such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism that cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like, as needed. A known shape, such as a roller shape or a web shape, can be used as a cleaning member used for cleaning.

As described above, in this embodiment, the application unit 5A, the absorption unit 5B, the heating unit 5C, and the cleaning unit 5D are included as the peripheral units. Cooling functions of the transfer member 2 may, however, be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2, such that the temperature of the discharged ink is maintained below the boiling point of water.

The cooling unit may be an air blowing mechanism that blows air to the transfer member 2, or a mechanism that brings a member (for example, a roller) into contact with the transfer member 2 and cools this member by air-cooling or water-cooling. The cooling unit may be a mechanism that cools the cleaning member of the cleaning unit 5D. A cooling timing may be a period before application of the reactive liquid after transfer.

Supply Unit

The supply unit 6 is a mechanism that supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism that deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Conveyance Apparatus

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit in which the plurality of print media P are stacked and a feeding mechanism that feeds the print media P one by one from the stacking unit to the most upstream conveyance drum 8. A sensor 71 is provided in a conveyance path of the print media P between the feeding unit 7 and a transfer unit 4. The sensor 71 detects a timing when a leading edge of a print medium P fed from the feeding unit 7 passes through the conveyance path. On the other hand, when a print medium runs out in the feeding unit, the sensor 71 no longer outputs a signal (PTOP) indicating that the leading edge of the print medium passes, thereby detecting that a print medium runs out. In other words, the sensor 71 detects the presence or the absence of a fed print medium. Each of the conveyance drums 8 and 8*a* is a rotating body that rotates about the rotation axis in the Y direction and has a columnar outer peripheral surface. At least one grip mechanism that grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums. Note that although a portion that the sensor 71 detects may be a tail edge of a print medium P, detection of a leading edge is exemplified in the following description.

The two conveyance drums 8*a* are used to reverse the print medium P. When the print medium P undergoes double-side printing, it is not transferred to the conveyance drum 8 adjacent on the downstream side, but is transferred to the conveyance drums 8*a* from the pressurizing drum 42 after transfer onto the surface. The print medium P is reversed via the two conveyance drums 8*a* and is transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P', gripped by the grip mechanism, is conveyed to the collection unit 8*d* by running the chain 8*c*, releasing gripping. Consequently, the printed product P' is stacked in the collection unit 8d.

Post Processing Unit

The conveyance apparatus 1B includes post processing units 10A and 10B. The post processing units 10A and 10B are mechanisms that are arranged on the downstream side of the transfer unit 4, and that perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, improving glossiness, and the like, of an image on the image printed surface of the printed product P'. For example, liquid application, sheet welding, lamination, and the like, can be used as an example of coating.

Inspection Unit

The conveyance apparatus 1B includes inspection units 9A and 9B. The inspection units 9A and 9B are mechanisms that are arranged on the downstream side of the transfer unit 4, and that inspect the printed product P'.

In this embodiment, the inspection unit 9A is an image capturing apparatus that captures an image printed on the printed product P' and includes an image sensor, for example, a charge coupled device (CCD) sensor, a complementary metal oxide semiconductor (CMOS) sensor, or the like. The inspection unit 9A captures a printed image while a printing operation is performed continuously. Based on the image captured by the inspection unit 9A, it is possible to confirm a temporal change in tint, or the like, of the printed image and to determine whether to correct image data or to print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

Control Unit

Figure 4:
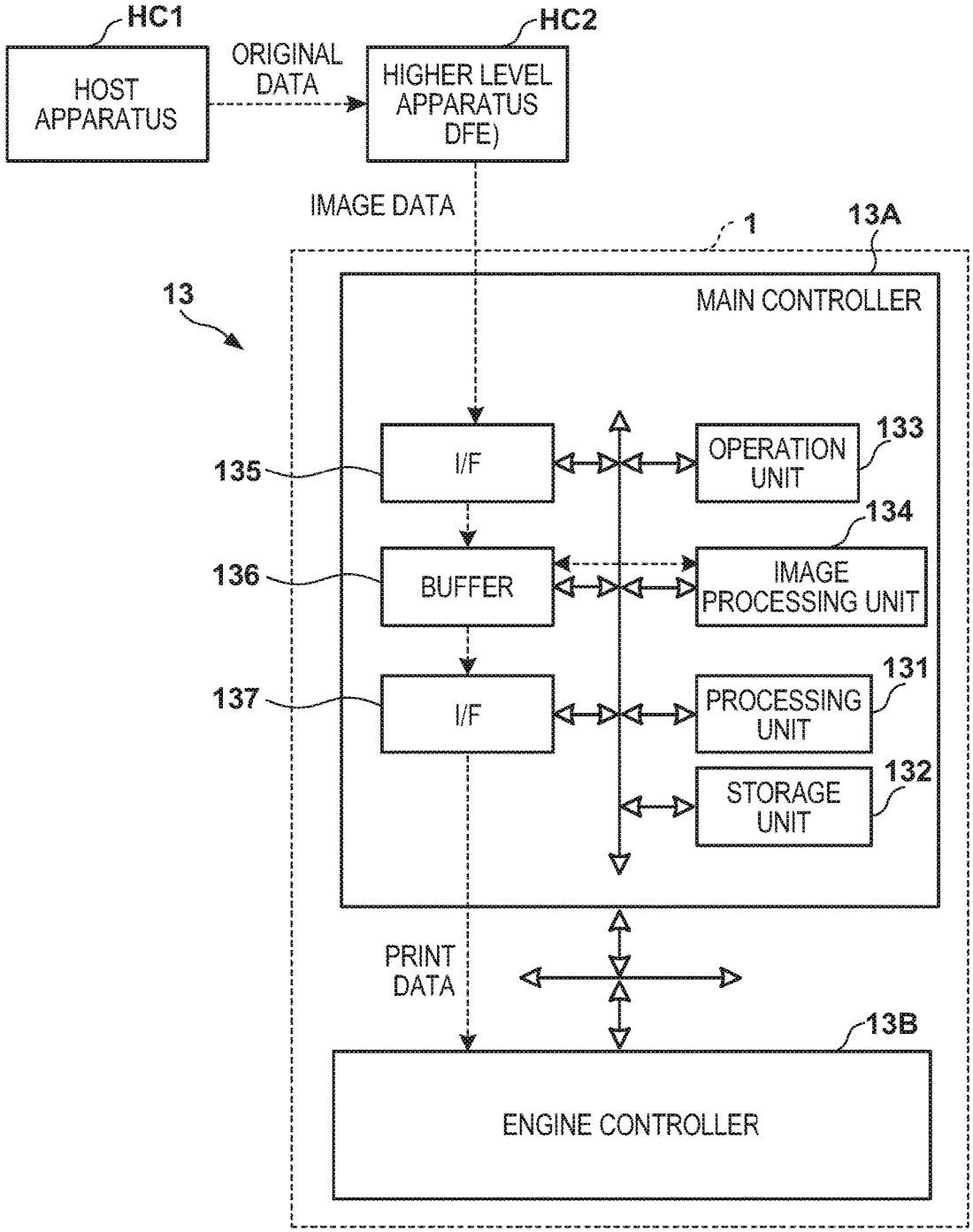
FIG. 4 is a block diagram showing a control system of the printing system in FIG. 1.
Figure 5:
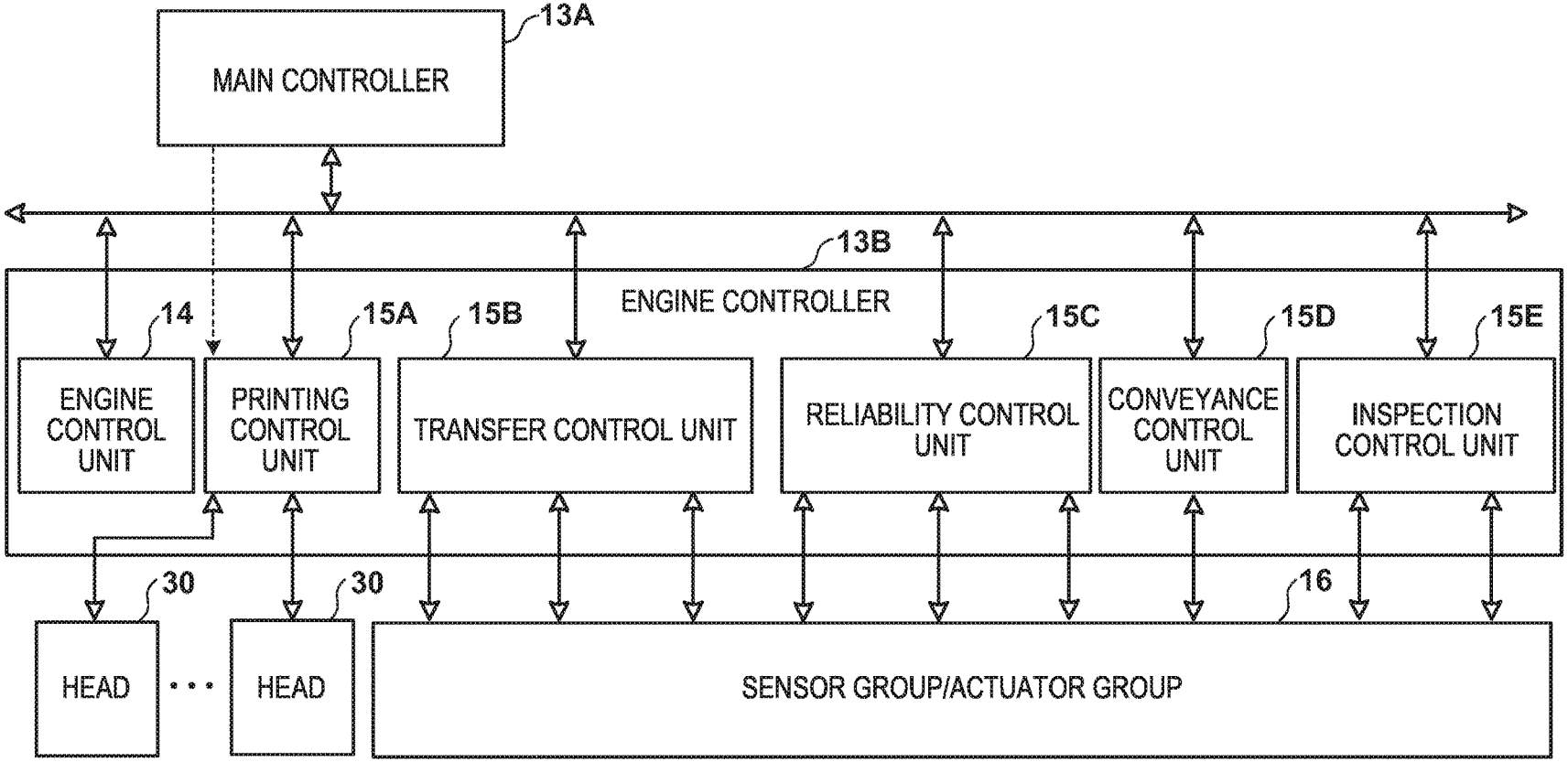
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a personal computer (PC) serving as an information processing apparatus, or a server apparatus. A communication method between the host apparatus HC1 and the higher level apparatus HC2 may be, without particular limitation, either a wired communication or a wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, red, green, blue (RGB) data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor, such as a central processing unit (CPU), that executes programs stored in the storage unit 132, and that controls the entire main controller 13A. The storage unit 132 is a storage device, such as a random access memory (RAM), a read only memory (ROM), a hard disk, or a sold state drive (SSD), stores data and the programs executed by the processing unit (CPU) 131, and provides the processing unit (CPU) 131 with a work area. An external storage unit may further be provided in addition to the storage unit 132. The operation unit 133 is, for example, an input device, such as a touch panel, a keyboard, or a mouse, and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication interface (I/F) 137 to the engine controller 13B as print data used by a print engine.

As shown in FIG. 5, the engine controller 13B includes engine control units 14 and 15A to 15E, and obtains a detection result of a sensor group/actuator group 16 of the printing system 1 and controls driving of the groups. Each of these control units includes a processor, such as a CPU, a storage device, such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data, or the like, in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
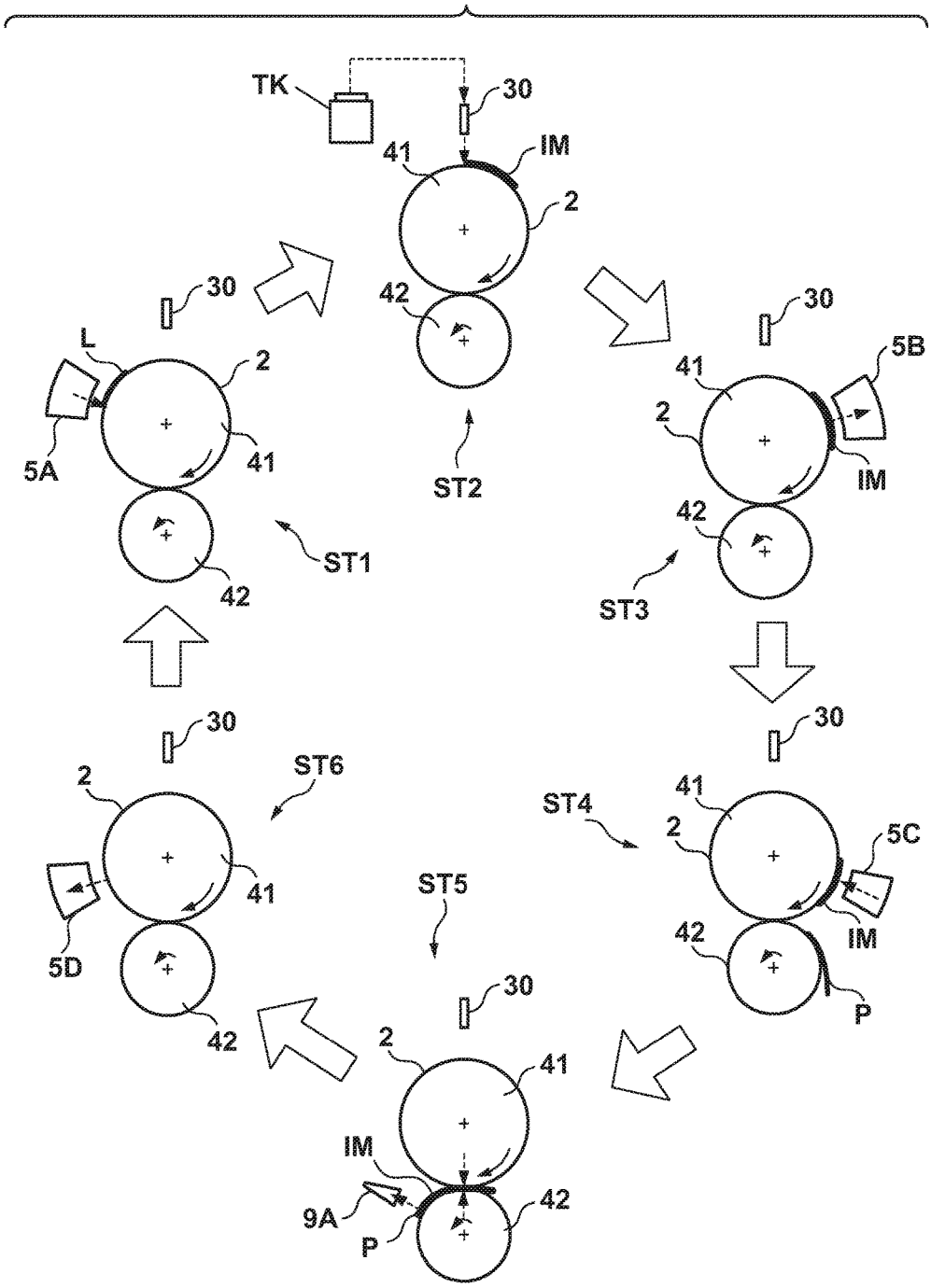
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion in which the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
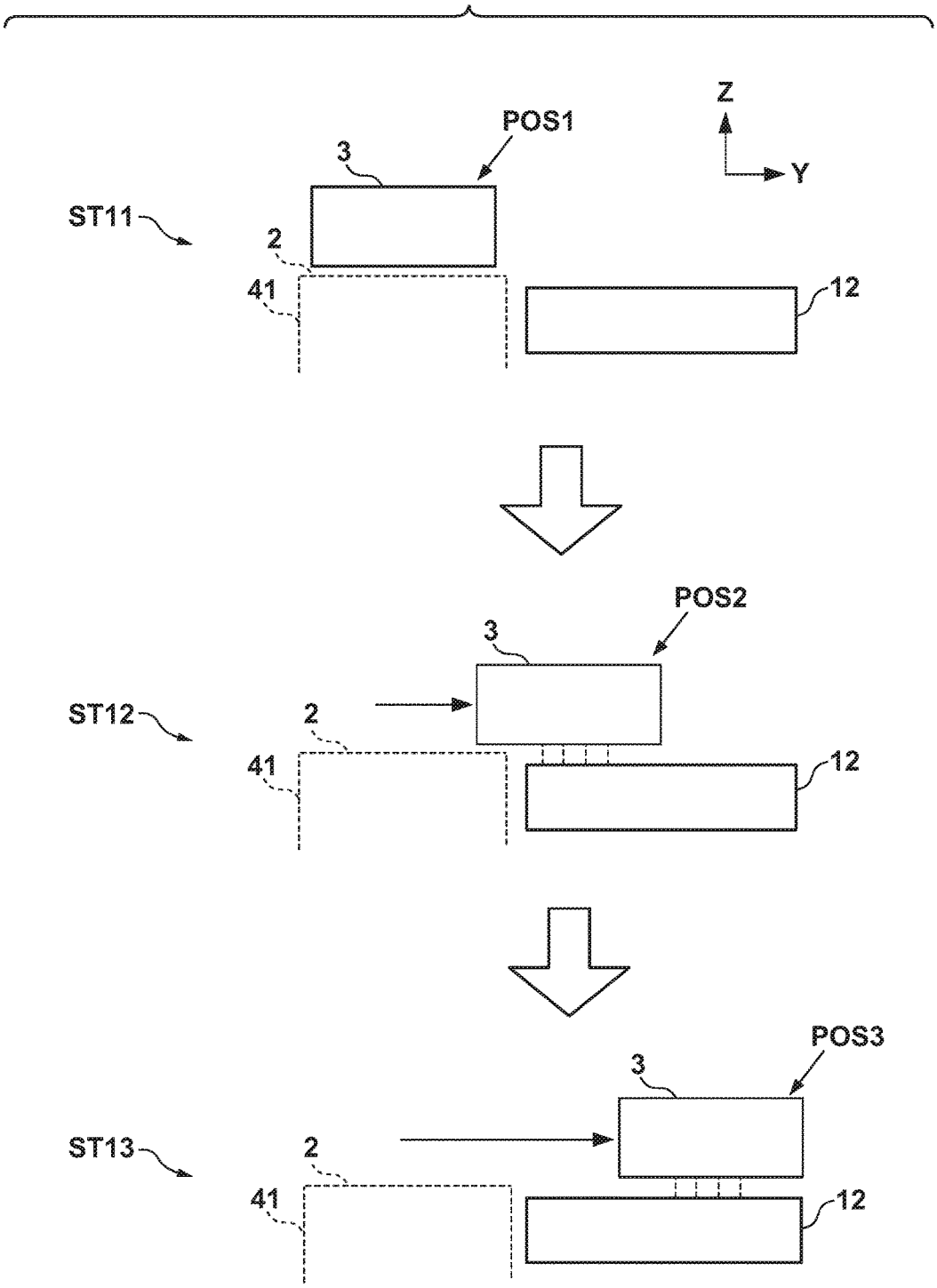
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

Print Control When Print Medium Runs Out in Double-Sided Printing Sequence

Print control when a print medium runs out during execution of a double-sided printing sequence in the printing system having the above arrangement will be described next. This print control is performed by causing the printing control unit 15A to control the printheads 30 based on an instruction from the main controller 13A.

In the printing system 1, it is possible to hold two print media P in a double-sided unit in the case of double-sided printing. That is, when performing double-sided printing on the print media P, the two conveyance drums 8*a* used as conveyance drums for reversing the print medium P form the double-sided unit, holding the two print media P after transfer to a front surface.

The sensor 71 detects the leading edge of the print medium P fed from the feeding unit 7. The detection result is notified to the main controller 13A and the printing control unit 15A via the conveyance control unit 15D. Based on the notification result of the sensor 71, the main controller 13A can determine that the print medium P is supplied or the print medium P runs out. Upon receiving the notification of the sensor 71, the printing control unit 15A generates a timing at which a heat window signal (HEATW1) for ink discharge is output. In the following description, print control when the sensor 71 detects that the print medium P runs out will be described in particular.

In the printing system 1, high-speed/high-quality printing is performed. Therefore, image data processing or control of a discharge timing of each printhead 30 is basically performed by hardware control.

Figure 8:
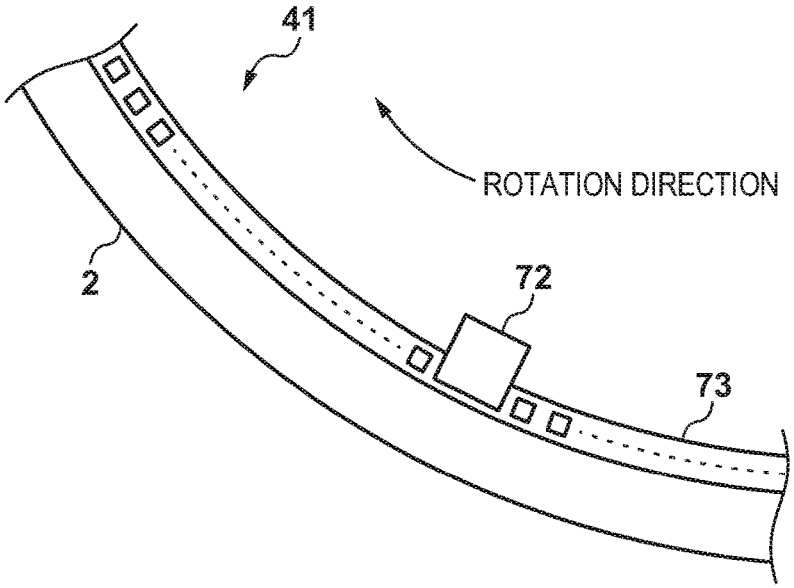
FIG. 8 is a view showing an arrangement that detects a rotation angle of the transfer member.

Generation of Block Trigger Signal (BTRG) (FIG. 8)

FIG. 8 is a view showing an arrangement that detects a rotation angle of the transfer member.

As shown in FIG. 8, a scale 73 having slits at a predetermined interval is attached inside the transfer drum 41 at a position in which the transfer member 2 is formed. An encoder 72 reads the scale 73, and an encoder signal with a pulse rising each time the slit is read is generated along with the rotation of the transfer member 2.

By counting the pulses of this encoder signal, the rotation angle of the transfer member 2, that is, the position of the transfer member 2 is obtained. Then, the block trigger signal (BTRG) needed to start printing from the position of the transfer member 2 is generated.

Figure 9:
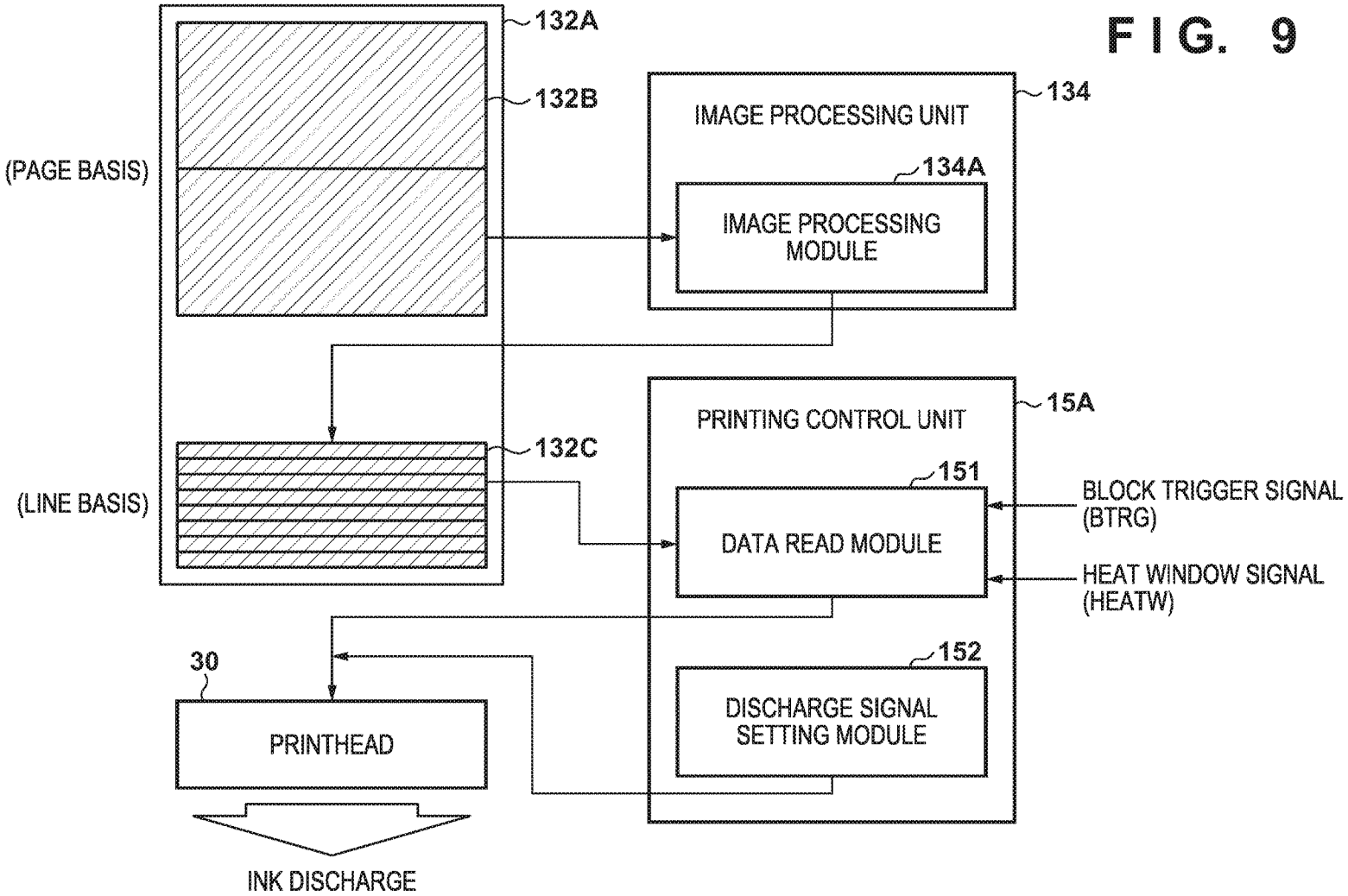
FIG. 9 is a block diagram showing the relationship among constituent elements related to print control based on image data.

Data Flow Control (FIG. 9)

FIG. 9 is a block diagram showing the relationship among constituent elements related to print control based on image data.

Image data used to perform printing on each print medium P is input from the outside of the printing system 1 on a page basis and stored in an input buffer 132B defined in a static RAM (SRAM) 132A of the storage unit 132. An image processing module 134A formed by an application specific integrated circuit (ASIC) or the like, in the image processing unit 134 performs image processing, such as index expansion/complementary processing for discharge failure nozzle, on the image data input on the page basis, as shown in FIG. 8. Then, the image processing module 134A converts the image data into data of one line of the printhead 30 and stores it on a line basis in a nozzle buffer 132C defined in the SRAM 132A. Note that the printheads 30 are provided for inks of respective colors. For the sake of descriptive simplicity, however, the data of one line used for printing of one printhead 30 is adopted here.

Note that the SRAM having a high access speed is used as a memory here for high-speed processing. The present invention is not, however, limited to the SRAM as long as a memory can cope with the high-speed processing.

On the other hand, a data read module 151 formed by the ASIC, or the like, of the printing control unit 15A reads out data for each line from the nozzle buffer 132C and transfers this data to the printhead 30.

Note that the data read module 151 reads out data on the line basis and transfers it to the printhead 30 for each pulse of the block trigger signal (BTRG) while a heat window signal (HEATWi) is input, and a heat window is opened. Consequently, the printhead 30 discharges ink in accordance with the transferred data. Note that the heat window signal (HEATWi) is a signal that opens windows by the number of lines in a print area of the print medium in synchronism with conveyance of the print medium P. The block trigger signal (BTRG) is a pulse signal generated based on the encoder signal output from the encoder 72.

A discharge signal setting module 152 can set the enabled/disabled state of data signal transmission from the data read module 151 to each head chip of the printhead. This will be described in detail later.

Then, the following processing is repeated during a printing operation. That is, processing inlcuding (1) always setting signal transmission in the discharge signal setting module 152 in an enabled state, (2) always receiving a block trigger signal in synchronism with the rotation of the transfer member 2, (3) generating a heat window signal in accordance with a conveyance timing of the print medium P, (4) in a section in which a heat window is opened, reading out data, transferring it to the printhead 30 by the data read module 151, and discharging ink, and (5) continuing data readout and writing next data in a free area of the nozzle buffer 132C by the data read module 151 is performed.

As described above, at the time of double-sided printing, the print medium is drawn into the double-sided unit capable of holding two print media, turned over, and conveyed to the transfer member 2 again after one-side printing. At this time, as is apparent from the structure shown in FIG. 1, the print medium does not pass through the sensor 71 before back surface printing on the print medium.

Figure 10:
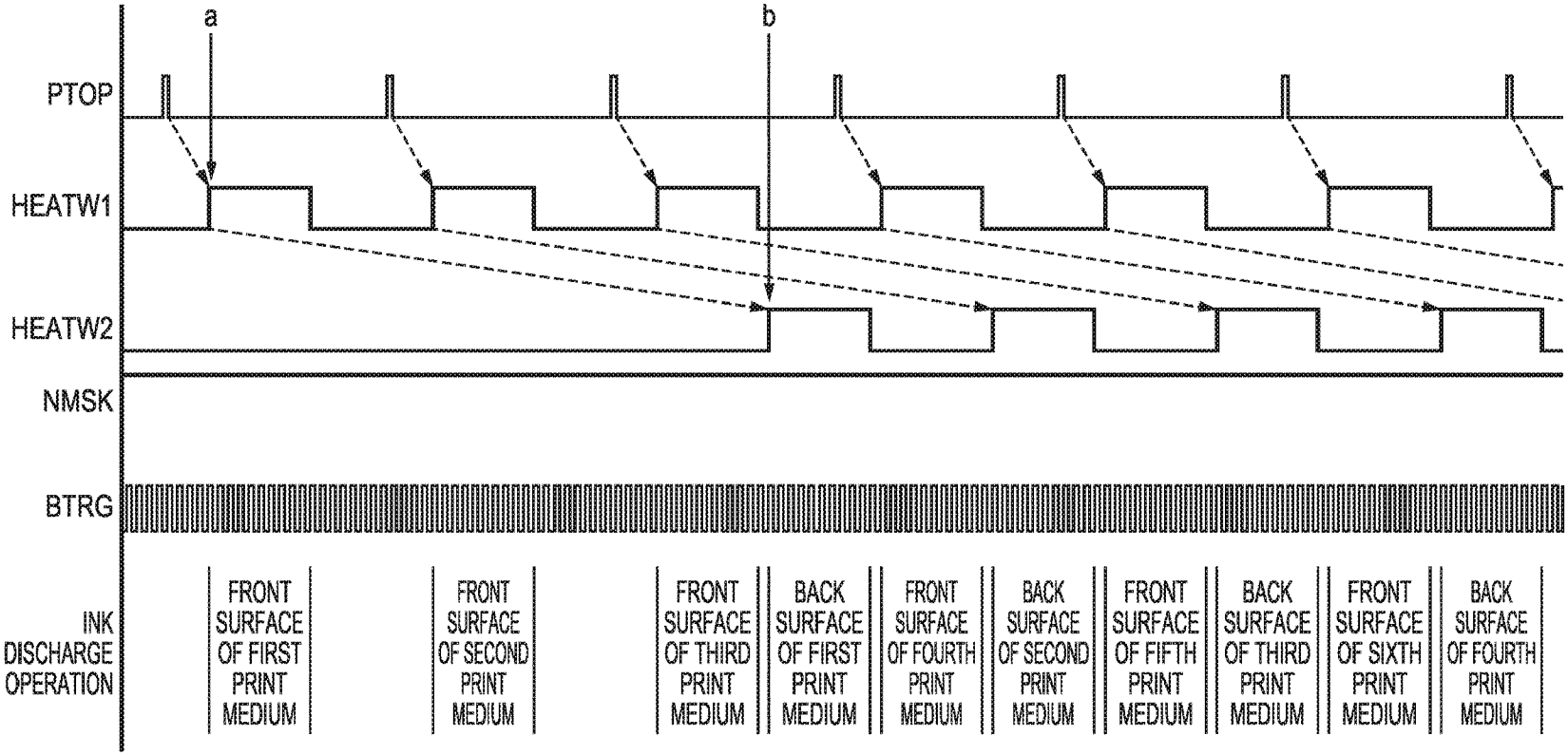
FIG. 10 is a sequence chart showing each signal waveform when double-sided printing is performed normally.
Figure 11:
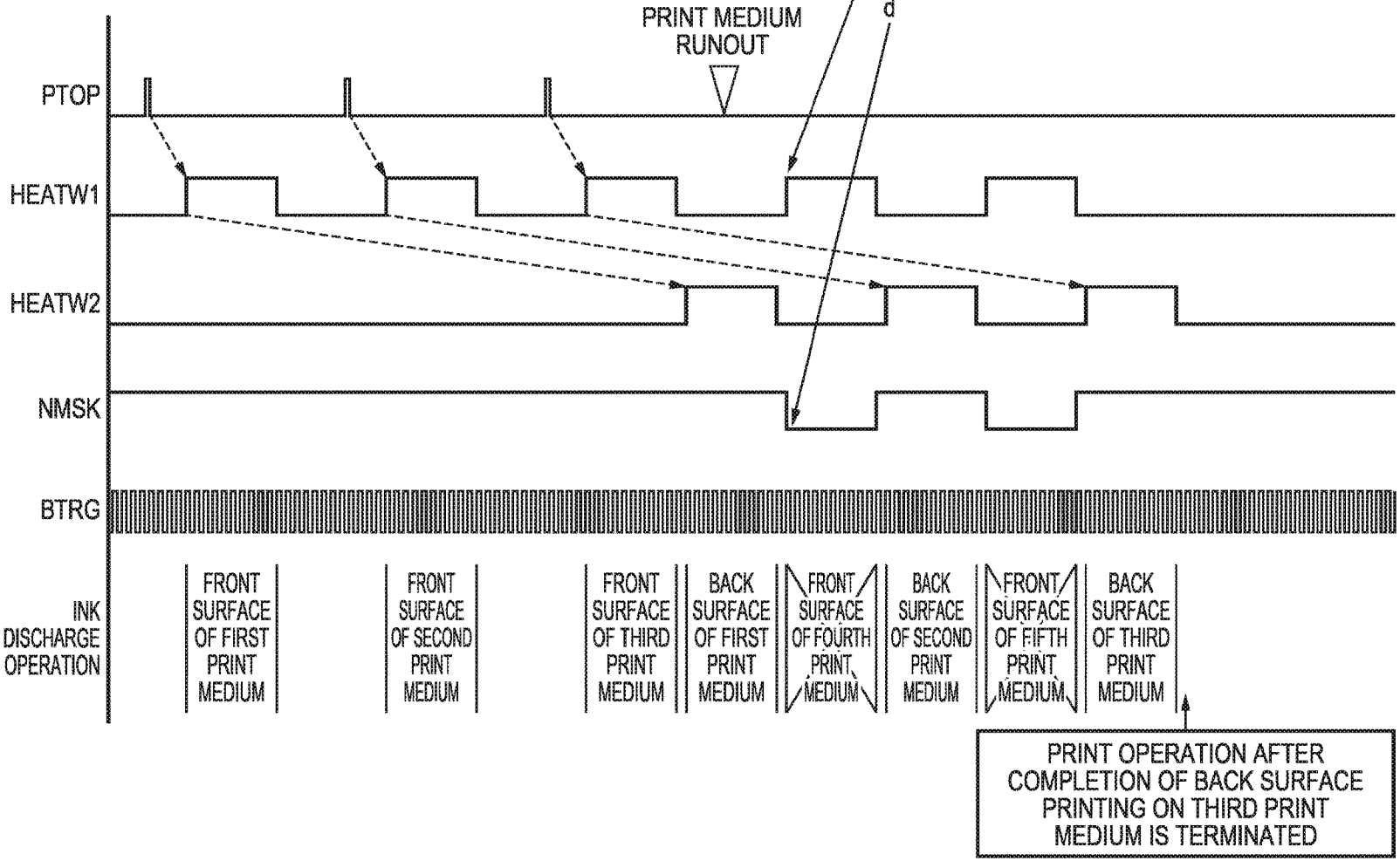
FIG. 11 is a sequence chart showing each signal waveform when a print medium runs out in the double-sided printing sequence.

Double-Sided Printing Sequence (FIGS. 10 and 11)

A. Normal Operation

FIG. 10 is a sequence chart showing each signal waveform when double-sided printing is performed normally.

According to FIG. 10, after the output of a leading edge detection signal (PTOP) of a print medium, the pulses of an encoder signal are counted by the predetermined number (a of FIG. 10), and then the heat window signal (HEATW1) on the front surface rises to open a heat window. After a rising timing of the heat window signal (HEATW1) on the front surface, encoder signals are counted by the predetermined number (b of FIG. 10), and then a heat window signal (HEATW2) on the back surface rises to open a heat window. The heat window is opened/closed by hardware processing, making it possible to print an image by discharging ink to an accurate position of the transfer member 2 in synchronism with conveyance of the print medium.

Note that an interval from rising of the heat window signal (HEATW1) on the front surface to rising of the heat window signal (HEATW2) on the back surface is determined in accordance with the number of print media to be held by the double-sided unit. In this embodiment, the double-sided unit can hold two print media. Therefore, control is performed, such that the heat window signal (HEATW2) on the back surface for performing printing on the back surface of the first print medium rises after a heat window based on the heat window signal (HEATW1) on the front surface for performing printing on the front surface of the third print medium is closed.

Note that as long as the double-sided printing sequence progresses normally, a masking signal (NMSK) that suppresses an ink discharge operation is never used.

As shown in FIG. 10, while the heat window signal (HEATW1) on the front surface rises, ink is discharged to the front surface of the print medium in synchronism with the block trigger signal (BTRG). On the other hand, while the heat window signal (HEATW2) on the back surface rises, ink discharge for transferring an image to the back surface of the print medium is performed in synchronism with the block trigger signal (BTRG).

In this embodiment, the double-sided unit can hold two print media each having undergone printing on the front surface. Therefore, in the double-sided printing sequence, front surface printing on the holdable number +1, that is, printing on three print media is performed, and then back surface printing on a print medium conveyed from the double-sided unit and front surface printing on a print medium fed from the feeding unit 7 are repeated alternately, as shown in FIG. 10.

B. Print Medium Runout

FIG. 11 is a sequence chart showing each signal waveform when a print medium runs out in the double-sided printing sequence. FIG. 11 shows an example of control when runout of the fourth print medium is detected after three print media are fed. Note that signals shown in FIG. 11 are the same as the signals shown in FIG. 10, and thus, a description of the signals will be omitted.

According to FIG. 11, when runout of the print medium is detected without rising of the pulse of the leading edge detection signal (PTOP) of the print medium, the double-sided unit holds the second and third print media. At this time, in accordance with a failure in detecting the pulse of the leading edge detection signal (PTOP) of the print medium for a predetermined time, the printing control unit 15A causes the data read module 151 to continue reading out data on a page of a runout print medium (the front surface of the fourth print medium). Then, the printing control unit 15A internally raises the heat window signal (HEATW1) on the front surface as an alternative signal and opens a heat window of one-page section by software control (c of FIG. 11). Furthermore, in order to avoid ink discharge to a page corresponding to the fourth print medium, the masking signal (NMSK) is enabled to perform nozzle masking while the heat window is opened. Thus, data from the nozzle buffer 132C is substantially read and discarded.

Nozzle masking here means control of blocking the output of a print signal to a nozzle of a printhead and prohibiting ink discharge.

This suppresses printing on the fourth and subsequent print media. On the other hand, the second and third print media, each having undergone printing on the front surface, are held in the double-sided unit, and thus, these print media are turned over and sequentially conveyed from the double-sided unit. Then, for the second and third print media, the heat window signal (HEATW2) on the back surface rises to open the heat window, and ink discharge for transferring images to the back surfaces of these print media is performed in synchronism with the block trigger signal (BTRG).

As described above, by the control as shown in FIG. 11, with respect to a page of a runout print medium, image data corresponding to the page is transferred to a printhead, but ink discharge is not performed by nozzle masking. Subsequently, a print operation is stopped after the completion of printing on the back surface of the print medium held by the double-sided unit (back surface printing on the third print medium in the example of FIG. 11).

Figure 12:
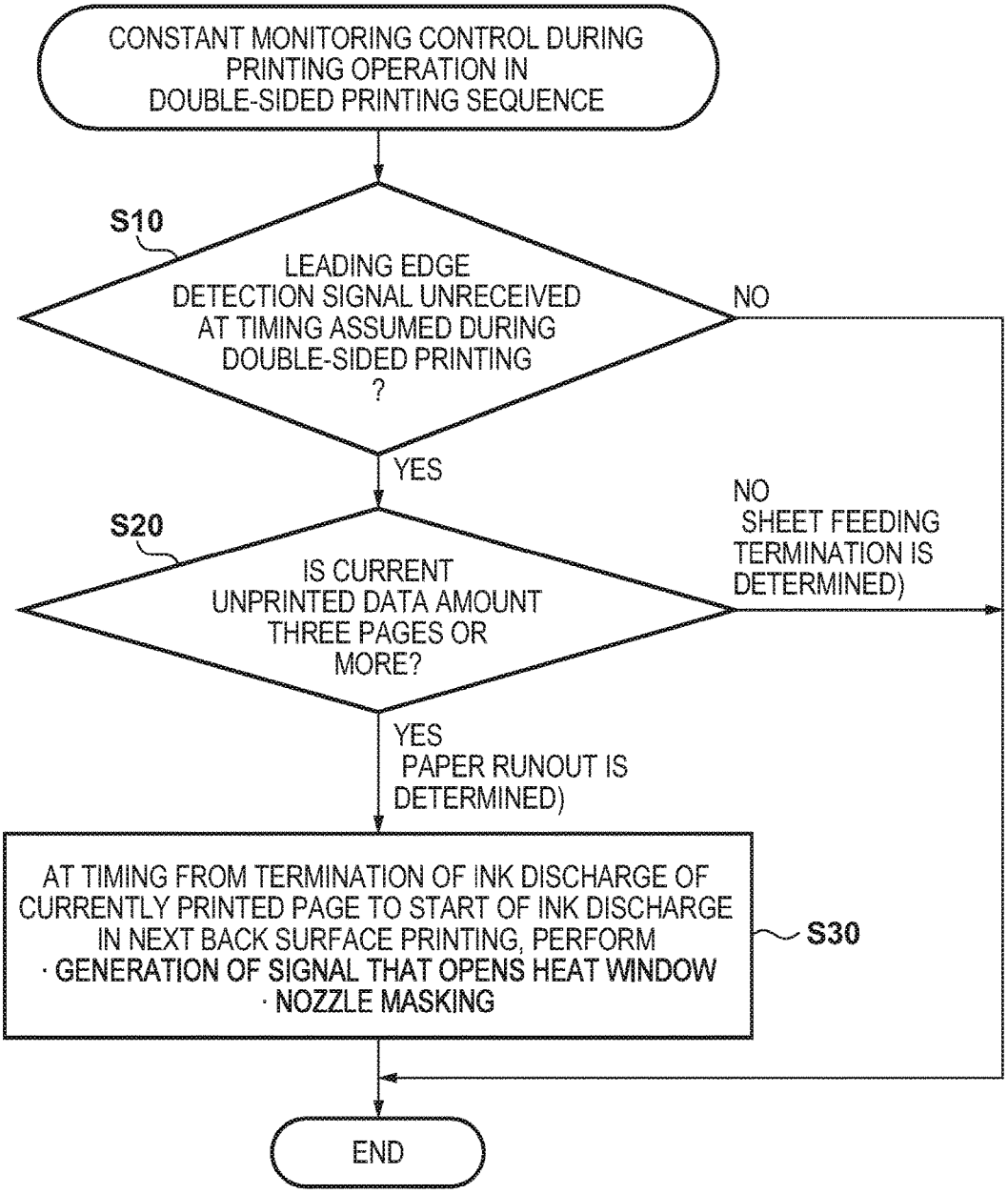
FIG. 12 is a flowchart showing print control of coping with runout of a print medium in a double-sided printing sequence.

FIG. 12 is a flowchart showing print control of the printing control unit 15A to cope with runout of a print medium in a double-sided printing sequence.

First, in step S10, it is checked whether the leading edge detection signal (PTOP) detects the leading edge of a print medium at a timing assumed during double-sided printing. If the leading edge of the print medium is detected here, the process is terminated. In contrast to this, if the leading edge of the print medium is not detected, the process advances to step S20.

Next, in step S20, it is checked whether a current unprinted data amount stored in the nozzle buffer 132C is three pages or more. If the current unprinted data amount is less than three pages (that is, two pages or less), feeding of a print medium from the feeding unit 7 is terminated, and it is determined that the print control to cope with runout of the print medium is not needed, terminating the process. In contrast to this, if the current unprinted data amount is three pages or more, runout of the print medium during a printing operation is determined, and the process advances to step S30.

In step S30, in a section (c and d of FIG. 11) from back surface printing on the first print medium to back surface printing on the second print medium, a heat window signal (HEATWs) as an alternative signal to open a heat window for a predetermined time is generated by software control. Furthermore, nozzle masking is performed in a section in which the heat window is opened. This suppresses front surface printing on the fourth print medium. Subsequently, back surface printing on the second print medium is performed in a normal way.

The same control is performed for front surface printing on the fifth print medium (which is not supplied in practice) to suppress the front surface printing, and back surface printing on the third print medium is performed in a normal way. After the completion of back surface printing on all print media held by the double-sided unit, the print operation is thus terminated. Then, occurrence of runout of a print medium is displayed as a message on a display, such as the operation unit 133, or the host apparatus HC1 or the higher level apparatus HC2 is notified of the occurrence of runout of a print medium.

Control at Time of One-Side Printing

Finally, print control when a print medium runs out during a one-side printing sequence will be described.

Figure 13:
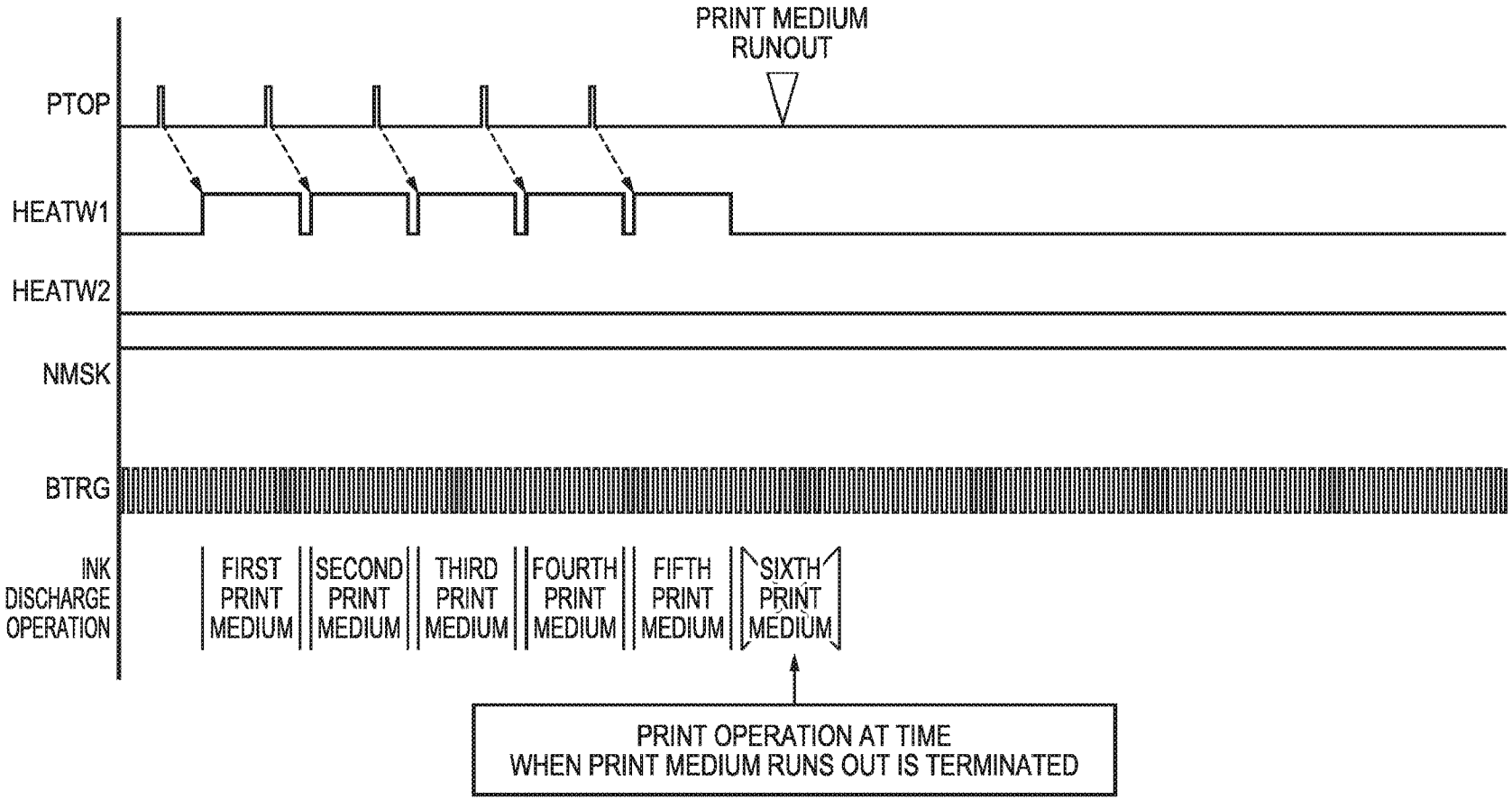
FIG. 13 is a sequence chart showing each signal waveform when the print medium runs out in the one-side printing sequence.

FIG. 13 is a sequence chart showing each signal waveform when the print medium runs out in the one-side printing sequence. Note that signals shown in FIG. 13 are the same as the signals shown in FIGS. 10 and 11, and thus, a description of the signals will be omitted.

According to FIG. 13, when runout of the print medium is detected without rising of the pulse of the leading edge detection signal (PTOP) of the print medium, the heat window signal (HEATW1) on the front surface does not rise, and the heat window is not opened. Therefore, nozzle masking control is not performed either. In addition, the heat window signal (HEATW2) on the back surface is not used. Consequently, the printing operation is terminated at the completion of printing on a print medium fed from the feeding unit 7.

In the example shown in FIG. 13, runout of the sixth print medium is detected and, in accordance with this detection, an ink discharge operation corresponding to printing on the sixth print medium is not performed.

Therefore, according to the above-described embodiment, when the leading edge detection signal of the print medium detects runout of the print medium during the double-sided printing sequence, ink discharge based on data used except for printing on a print medium held by the double-sided unit is suppressed. Then, printing is terminated at time when printing on all print media held by the double-sided unit is terminated. Particularly, in this embodiment, print control using hardware, such as the ASIC, is performed, making it possible to cope with high-speed control as well, and the present invention is applicable to a printing apparatus or a printing system that performs high-speed printing.

Note that in the above-described embodiment, the double-sided unit can hold two print media. The present invention is not, however, limited to this. The present invention is also applied to an arrangement capable of holding one, or three or more print media. In this case, in accordance with the holdable number, printing is terminated at a time when double-sided printing on these print media is terminated, as a matter of course.

Moreover, in the above-described embodiment, the alternative signals are generated by the software control. The present invention is not, however, limited to this. When higher-speed control is required, a hardware circuit that generates an alternative signal in accordance with detection of runout of a print medium by the leading edge detection signal (PTOP) may be included.

In the above embodiment, the print unit 3 includes the plurality of printheads 30. A print unit 3 may, however, include one printhead 30. The printhead 30 may not be a full-line head but may be of a serial type that forms an ink image by discharging ink from the printhead 30 while scanning the printhead 30 in a Y direction.

A conveyance mechanism of the print medium P may adopt another method, such as a method of clipping and conveying the print medium P by the pair of rollers. In the method of conveying the print medium P by the pair of rollers, or the like, a roll sheet may be used as the print medium P, and a printed product P' may be formed by cutting the roll sheet after transfer.

In the above embodiment, the transfer member 2 is provided on the outer peripheral surface of the transfer drum 41. Another method, such as a method of forming a transfer member 2 into an endless swath and running it cyclically, may, however, be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus comprising:

a storage unit configured to externally receive and to store image data used to print images;

a detection unit configured to detect presence and absence of a print medium fed from a feeding unit;

a print unit configured to read out, in accordance with detection of the print medium fed from the feeding unit by the detection unit, the image data for printing an image on the print medium, detected by the detection unit, from the storage unit, and to print the image on the print medium based on the image data;

a hold unit configured to hold a print medium, with an image being printed on a first surface, to print on a second surface, as a back surface of the first surface, in double-sided printing; and a control unit configured to control, if the detection unit detects that a print medium fed from the feeding unit runs out, while the hold unit holds the print medium, with the image being printed on the first surface by the print unit, during execution of a sequence of the double-sided printing, data reading so as to read and to discard image data, corresponding to an image to be printed on the runout print medium, from the storage unit, to cause a conveyance unit to convey the held print medium from the hold unit to the print unit, and to cause the print unit to print an image on the second surface of the held print medium.

2. The apparatus according to claim 1, wherein the control unit terminates the sequence of the double-sided printing after printing on the second surface of the print medium, held by the hold unit, is terminated.

3. The apparatus according to claim 1, further comprising a notification unit configured to notify that the print medium fed from the feeding unit runs out.

4. The apparatus according to claim 1, further comprising a masking unit configured to mask the image data used for printing by the print unit, wherein reading and discarding of the image data in the control unit are performed by causing the masking unit to mask the image data read out from the storage unit.

5. The apparatus according to claim 1, wherein the detection unit includes a sensor configured to detect an edge of the print medium fed from the feeding unit, and the print unit reads out the image data from the storage unit based on a signal indicating detection of the edge of the print medium output by the sensor.

6. The apparatus according to claim 5, further comprising a generation unit configured to generate, in accordance with runout of a print medium fed from the feeding unit and absence of the signal indicating detection of the edge of the print medium output by the sensor, an alternative signal for reading out the image data from the storage unit, wherein, based on the alternative signal, the control unit reads and discards the image data corresponding to the image to be printed on the runout print medium from the storage unit.

7. The apparatus according to claim 1, wherein, in the sequence of the double-sided printing, printing on first surfaces of print media of a number, determined based on a number of print media to be held by the hold unit, is performed first, and then, printing on a second surface of a print medium conveyed from the hold unit and printing on a first surface of a print medium fed from the feeding unit are repeated alternately.

8. The apparatus according to claim 7, wherein, in the sequence of the double-sided printing, the print unit generates a first signal, for control of performing printing on a first surface of a print medium fed from the feeding unit, after a predetermined time from a timing at which the detection unit detects the print medium, and, after the first signal is generated, the print unit generates a second signal, for control of performing printing on second surfaces of print media to be held by the hold unit, after a time determined based on a number of holdable print media.

9. The apparatus according to claim 1, wherein the print unit includes a printhead configured to form an image by discharging ink.

10. The apparatus according to claim 9, wherein the print unit further includes:

a transfer member configured to form the image by the ink discharged from the printhead; and a transfer unit configured to transfer, to a print medium, the image formed on the transfer member.

11. The apparatus according to claim 9, wherein the printhead prints the image by discharging the ink to a print medium.

12. The apparatus according to claim 1, wherein the control unit is formed by an application specific integrated circuit (ASIC).

13. A print control method of controlling a printing apparatus, the method comprising:

externally receiving and storing image data used to print the images in a memory;

detecting, using a sensor, presence and absence of a print medium fed from a feeding unit;

reading out, in accordance with detection of the print medium fed from the feeding unit by the sensor, the image data for printing an image on the detected print medium from the memory, and printing the image on the print medium based on the image data;

holding, using a double-sided unit, a print medium, with an image being printed on a first surface, to print on a second surface, as a back surface of the first surface, in double-sided printing; and controlling, if the sensor detects that a print medium fed from the feeding unit runs out, while the double-sided unit holds the print medium, with the image being printed on the first surface by the printing, during execution of a sequence of the double-sided printing, data reading so as to read and to discard image data corresponding to an image to be printed on the runout print medium from the memory, to cause a conveyance unit to convey the print medium held by the double-sided unit from the double-sided unit, and to cause a print unit to print an image on the second surface of the held print medium.

14. The method according to claim 13, wherein, in the controlling, the sequence of the double-sided printing is terminated after printing on the second surface of the print medium, held by the double-sided unit, is terminated.

15. The method according to claim 13, further comprising notifying that the print medium fed from the feeding unit runs out.

16. The method according to claim 13, further comprising masking the image data used for the printing, wherein reading and discarding of the image data in the controlling are performed by performing the masking on the image data read out from the memory.

17. The method according to claim 13, wherein the sensor detects an edge of the print medium fed from the feeding unit, and, in the printing, the image data is read out from the memory based on a signal indicating detection of the edge of the print medium output by the sensor.

18. The method according to claim 17, further comprising generating, in accordance with runout of a print medium fed from the feeding unit and absence of the signal indicating detection of the edge of the print medium output by the sensor, an alternative signal for reading out the image data from the memory, wherein, in the controlling, based on the alternative signal, the image data corresponding to the image to be printed on the runout print medium is read and discarded from the memory.

19. The method according to claim 13, wherein, in the sequence of the double-sided printing, printing on first surfaces of print media of a number, determined based on a number of print media to be held by the double-sided unit, is performed first, and then, printing on a second surface of a print medium conveyed from the double-sided unit and printing on a first surface of a print medium fed from the feeding unit are repeated alternately.

20. The method according to claim 19, wherein, in the printing, in the sequence of the double-sided printing, a first signal, for control of performing printing on a first surface of a print medium fed from the feeding unit, after a predetermined time from a timing at which the sensor detects the print medium, is generated, and, after the first signal is generated, a second signal, for control of performing printing on second surfaces of print media to be held by the double-sided unit, is generated after a time determined based on a number of holdable print media.

* * * * *